US005263476A

United States Patent [19]

Henson

[11] Patent Number: 5,263,476

[45] Date of Patent: Nov. 23, 1993

[54] ENCLOSURE SYSTEM FOR BURN VICTIMS

[75] Inventor: Dennis L. Henson, Crowley, Tex.

[73] Assignee: Henson-Thiery Corporation, Palos Heights, Ill.

[21] Appl. No.: 11,838

[22] Filed: Feb. 1, 1993

Related U.S. Application Data

[63] Continuation of Ser. No. 726,565, Jul. 8, 1991, abandoned.

[51] Int. Cl.[5] ..... A61G 10/00

[52] U.S. Cl. ..... 128/204.18; 128/204.21; 128/205.11; 128/205.26

[58] Field of Search ..... 128/202.12, 202.13, 128/202.14, 200.24, 202.16, 204.18, 204.21, 205.11, 205.12, 205.26; 600/21, 22; 55/385.2; 454/187, 58

[56] References Cited

U.S. PATENT DOCUMENTS

| | | | |
|---|---|---|---|
| 1,913,347 | 6/1933 | Taylor . | |
| 2,180,631 | 11/1939 | Hetessy . | |
| 2,439,806 | 4/1948 | Heineman | 128/202.12 X |
| 2,920,622 | 1/1960 | Steel | 128/205.26 X |
| 3,338,233 | 8/1967 | Grosholz et al. | 600/22 |
| 3,404,684 | 10/1968 | Brewer et al. . | |
| 3,490,443 | 1/1970 | Decupper | 600/21 X |
| 3,492,987 | 3/1970 | Parker | 128/205.26 X |
| 3,511,162 | 5/1970 | Truhan . | |
| 3,529,590 | 9/1970 | Grosholtz | 600/22 |
| 3,587,574 | 6/1971 | Mercer | 128/205.26 |
| 3,709,210 | 1/1973 | Matthews | 128/205.26 X |
| 3,782,362 | 1/1974 | Puzio | 128/205.26 X |
| 3,877,427 | 4/1975 | Alexeev et al. | 128/202.13 |
| 3,999,541 | 12/1976 | Tabor . | |
| 4,129,122 | 12/1978 | Dout et al. | 600/21 |
| 4,161,172 | 7/1979 | Pickering | 128/205.26 X |
| 4,224,936 | 9/1980 | Cox . | |
| 4,296,743 | 10/1981 | Lasley | 600/21 X |
| 4,304,224 | 12/1981 | Fortney | 128/201.29 X |
| 4,509,505 | 4/1985 | Mercey et al. | 600/22 |
| 4,974,829 | 12/1990 | Gamow et al. | 128/205.26 X |
| 5,010,777 | 4/1991 | Yehl et al. | 55/385.2 X |
| 5,060,644 | 10/1991 | Lorri | 128/202.12 |

*Primary Examiner*—V. Millin
*Assistant Examiner*—Sebastiano Passaniti
*Attorney, Agent, or Firm*—Edward D. Gilhooly, Ltd.

[57] ABSTRACT

A sterile burn enclosure system for subjecting infected and non-fected burn victims to controlled conditions, including high concentrations of oxygen, humidity and temperature. A programmable controller maintains preset values of the foregoing paramters to control the gas flow introduced into the enclosure.

4 Claims, 1 Drawing Sheet

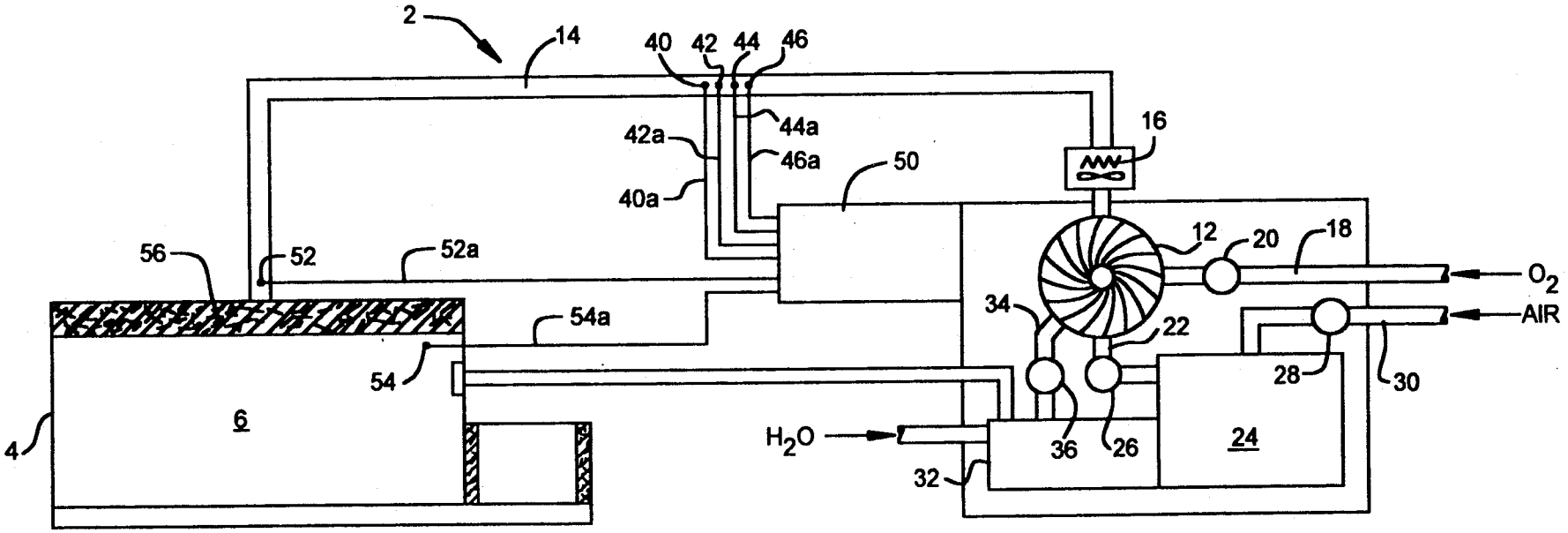
O2
AIR
30
18
28
20
24
12
22
16
26
36
34
32
50
H2O
46
44a
46a
44
42
40
42a
40a
14
54a
2
52a
54
52
6
56
4

ENCLOSURE SYSTEM FOR BURN VICTIMS

This is a continuation of co-pending application Ser. No. 726,565 filed Jul. 8, 1991 now abandoned.

BACKGROUND OF THE INVENTION

1. Field of the Invention

This invention relates in general to medical apparatus and more specifically, to an enclosure system for burn victims and the like.

2. Description of the Prior Art

Dependent on the severity of the wound, numerous difficulties are associated with the treatment of patients who have sustained skin burns. Medical treatment of such burns generally involves a number of different procedures which require a lengthy healing process commensurate with the level of trauma to the skin tissue. Medical experts have theorized that the healing of burn injuries as well as possibly other conditions such as caused by diabetes and the like can be accelerated through control of certain physical parameters to which the burn is subjected. It has been discovered, for example, that burn injuries respond very positively to the increased presence of oxygen and such exposure appears to significantly increase the healing process. Moreover, other parameters such as temperature, moisture and the like, appear also to be instrumental in the treatment of wounds sustained from burns or sores from diabetic conditions. In the prior art no single system is presently available that not only can subject a patient effectively to high concentrations of oxygen in treatment of burns and the like, but also can control simultaneously such conditions as temperature, moisture, pressure and the like. Accordingly, it is desirable that an improved system be provided that can effectively treat individuals who have sustained wounds due to burns or have open wounds or sores from other medical conditions such as caused by diabetes.

SUMMARY OF THE INVENTION

It is therefore an objective of the present invention to provide an improved enclosure system for treating burn victims. The enclosure system herein disclosed is intended to provide an air-tight and sterile enclosure for the patient to which high concentrations of oxygen are introduced under controlled conditions. Further, the system of the invention includes means to control the humidity, temperature and pressure within the enclosure, additional parameters associated with the effective treatment of burn wounds. The invention utilizes a computer controlled system by which sensors insure that the foregoing parameters are accurately and effectively controlled for the benefit of the-patient. The system of the application further includes such monitoring indicators and alarms that insure the safety of the patient being treated and to regulate the parameters that contribute successful treatment.

BRIEF DESCRIPTION OF THE DRAWINGS

The figure is a schematic view of the enclosure system for burn victims of the invention.

BRIEF DESCRIPTION OF THE PREFERRED EMBODIMENT

Referring now to the figure, there is illustrated the components of the improved burn enclosure system for burn victims of the invention, generally designated by reference numeral 2. The system 2 includes an enclosure or housing 4 of a size sufficient to enclose the patient being treated or at least the portion of the body being treated. Enclosure 4 may be constructed of any suitable material, such as with four vertical sidewalls 6 of transparent plexiglas, to insure the observation of the victim being treated, a suitable bottom floor 8, and top plate 8. The foregoing structure forming enclosure 4 is airtight through the employment of suitable sealing elements (not shown).

Physical conditions within the enclosure 4 are controlled by a parameter control system 10 by which a variety of parameters within the enclosure 4 are supplied and controlled. The system 10 includes a fan 12 of any suitable type such as the rotary design as shown and the like which supplies a gas flow of air treated with increased moisture and oxygen into the enclosure 4 through a conduit 14 as will be apparent. A heater 16 is disposed at the outlet of the fan 12 to regulate the temperature of the air being introduced into the enclosure 4. The fan 12 is in fluid communication via conduit 18 to a suitable supply of oxygen (not shown) in form of a tank and the like. The oxygen is regulated by a valve 20 and is drawn into the enclosure 4 by the operation of the fan 12. The fan 12 also introduces atmospheric air through conduit 22. The temperature and humidity of the air being supplied is further regulated through a conventional air conditioner unit 24.

The flow rate of air is controlled by valve 26 within conduit 22 and valve 28 within conduit 30 supplying air to air conditioner 24. A standard pressurized water tank 32, having means to produce a mist, is also used in conjunction with the system 10 and is coupled to a conduit 34 to direct mist to the fan 12 for delivery in the gas flow generated by fan 12. A control valve can also be provided within the conduit 34 to regulate the introduction of mist to fan 12. A supply pipe 38 supplies water to tank 32.

As should be apparent the fan 12 acts to deliver a supply of oxygen, atmospheric air, the latter being conditioned by an air conditioner, and moisture for delivery in a positive gas flow to the enclosure 4 containing the individual being treated. The amount of oxygen introduced into enclosure 4 can be elevated in accordance to the level of concentration found to be acceptable and useful in the treatment of burns, whether in the case of an infected or non-infected patient. The concentration of the oxygen and moisture along with magnitude of temperature and pressure of the gas flow within conduit 14 are all monitored by a plurality of sensors, such as heat sensor 40, moisture sensor 42, oxygen sensor 44 and air flow sensor 46, collectively mounted at the outlet of the fan in conduit 14. The heat sensor 40, moisture sensor 42, oxygen sensor 44 and air velocity sensor 46 are all conventional in design and provide a respective output in the form of an electrical control signal representative of the parameter being monitored. The heat sensor 40 measures temperature of the air. The moisture sensor 42 measures the humidity of the air. The oxygen sensor 44 detects the concentration of oxygen being introduced into the enclosure 4. The flow detector measure the flow rate through conduit 14. The electrical outputs from sensors 40, 42, 44 and 46 are directed through respective leads **40*a*, 42*a*, 44*a* and 46*a* to a programable controller 50. The controller compares the various parameter outputs from sensors 40, 42, 44 and 46 with predetermined selected values and directs control signals to the control valves 20, 26, 28 and 36, and fan 12 and heater 16 through electrical leads (not shown) . The programable controller 50 may comprise a suitable electrical device capable of comparing the electrical signals from the sensor 40, 42, 44 and 46** with preset valves representing temperature, moisture, oxygen and flow levels and regulating the control valves, fan output and beater output to regulate and control such parameters in the gas flow within conduit.

In addition, pressure sensors 52 and 54 measure pressure drop across a HEPA filter 56 between conduit 14 and patient enclosure 4. The HEPA is a known particulate air filter, such as a filter having a teflon membrane forming a hydrophobic agent, and being capable of removing in excess of 99.0% of particulates and bacteria approximately 0.22 micron in diameter and larger. Such a filter 56 contributes to a sterile environment within the patient enclosure. The differential pressure sensors 52 and 54 detect whether a sufficient flow across filter 56 is present for the patient. Electrical leads 52*a* and 54*a* connect the pressure sensors 52 and 54 to the programmable controller 50. An audible alarm (not shown) may be coupled to the programmable controller 50 for providing a warning signal that an incorrect gas flow entering the enclosure 4 based on the outputs of pressure sensors 52 and 54. The outputs from pressure sensors 52 and 54 may also be used by programmable controller 50 to control the output of fan 12.

What is claimed is:

1. An enclosure apparatus for treating infected and non-infected wounds from skin burns comprising enclosure means for enclosing a patient being treated for infected and non-infected skin burn wounds in a sterile environment, conduit means coupled to said enclosure means for introducing a gas flow into said enclosure means, said conduit means having a fan means for creating a positive pressure of said gas flow in said conduit means, first supply means being in fluid communication with said conduit means for introducing increased oxygen concentration to said gas flow for delivering to said enclosure means a gas flow having increased oxygen levels sufficient to increase the healing process of the burn injuries of the patient, said first supply means having oxygen valve means for controlling the oxygen concentration in said gas flow, second supply means for supplying air to said fan means for creating said gas flow to said enclosure means through said conduit means, said second supply means having air valve means for controlling the introduction of air to said conduit means, third supply means for supplying a mist of liquid to said fan means for adjusting the humidity level of said gas flow to said enclosure through said conduit means, said third supply means having liquid valve means controlling the introduction of mist to said conduit means, control means for respectively monitoring the concentration of oxygen of said gas flow, the flow rate of said gas flow, and the humidity level of said gas flow, said control means having a plurality of detectors in said conduit means for respectively controlling said oxygen valve means, said air valve means, and said liquid valve means, a HEPA filter being mounted in said conduit means for removing bacteria particles and particulate material from said gas flow for maintaining a sterile environment in said enclosure means, and said control means further sensing the pressure drop across said HEPA filter for maintaining a predetermined gas flow into said enclosure means.

2. The apparatus according to claim 1 further including heater means mounted in said conduit means for controlling the temperature of said gas flow.

3. The apparatus according to claim 1 wherein said control means controls the levels of oxygen, air and moisture in accordance with preset valves.

4. The apparatus according to claim 3 wherein said control means is further connected to said heater means, heat sensor means being mounted in said conduit means and being operatively coupled to said control means, and said control means acting to be responsive to said heat sensor means and control the heater means in said conduit means for maintaining a predetermined temperature level of said gas flow.

* * * * *